US007047591B2

(12) United States Patent
Hohlbein

(10) Patent No.: US 7,047,591 B2
(45) Date of Patent: May 23, 2006

(54) ORAL CARE IMPLEMENT

(75) Inventor: Douglas J. Hohlbein, Pennington, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/902,257

(22) Filed: Jul. 30, 2004

(65) Prior Publication Data

US 2005/0044647 A1 Mar. 3, 2005

Related U.S. Application Data

(63) Continuation-in-part of application No. PCT/US03/29497, filed on Sep. 17, 2003, and a continuation-in-part of application No. 29/189,729, filed on Sep. 10, 2003.

(60) Provisional application No. 60/412,290, filed on Sep. 20, 2002.

(51) Int. Cl.
*A46B 5/02* (2006.01)

(52) U.S. Cl. ..... 15/143.1; 15/167.1; 16/430; 16/436; 16/DIG. 19

(58) Field of Classification Search ..... 15/143.1, 15/167.1; 16/431, 436, DIG. 12, DIG. 19, 16/430; 132/321, 323; 433/141; 601/141; 606/161

See application file for complete search history.

(56) References Cited

U.S. PATENT DOCUMENTS

| | | | | |
|---|---|---|---|---|
| 1,796,001 | A | | 3/1931 | Church |
| 2,263,885 | A | | 11/1941 | McGauley |
| 3,185,582 | A | | 5/1965 | Viator |
| 3,848,871 | A | * | 11/1974 | Sweet et al. ..... 473/549 |
| 4,712,304 | A | * | 12/1987 | Sanelli ..... 30/343 |
| 4,721,021 | A | | 1/1988 | Kusznir |
| D317,986 | S | | 7/1991 | Huang |
| 5,052,071 | A | * | 10/1991 | Halm ..... 15/167.1 |
| 5,054,154 | A | | 10/1991 | Schiffer et al. |
| D334,288 | S | | 3/1993 | Witzig-Jaggi |
| 5,339,482 | A | | 8/1994 | Desimone et al. |
| 5,398,369 | A | | 3/1995 | Heinzelman et al. |
| D358,938 | S | | 6/1995 | Schneider et al. |
| D368,163 | S | | 3/1996 | Overthun |
| D371,680 | S | | 7/1996 | Juhlin et al. |
| D376,695 | S | | 12/1996 | Tveras |
| 5,673,454 | A | | 10/1997 | Quintanilla et al. |
| 5,735,012 | A | | 4/1998 | Heinzelman et al. |
| 5,781,958 | A | | 7/1998 | Meessmann et al. |
| 5,860,183 | A | | 1/1999 | Kam |
| 5,875,510 | A | | 3/1999 | Lamond et al. |
| 5,908,038 | A | | 6/1999 | Bennett |

(Continued)

FOREIGN PATENT DOCUMENTS

| | | |
|---|---|---|
| WO | WO 00/64306 | 11/2000 |

(Continued)

*Primary Examiner*—Mark Spisich
(74) *Attorney, Agent, or Firm*—Harris A. Wolin

(57) ABSTRACT

An oral care implement has an improved handle for control. The handle may include a gripping region having a grip surface with a plurality of spaced slot openings exposing portions of the base. In one construction, the handle may have an inclined portion and a grip body extending through a base of the handle. The grip body forms opposite finger grips on the inclined portion of the handle. In one construction, the handle may include a grip element which provides shifting of a mass centroid of the handle during use. In another construction, the handle includes a resilient grip body and the handle includes an aperture extend through the handle. Aperture has an inclined surface for engaging a resilient grip body.

34 Claims, 6 Drawing Sheets

U.S. PATENT DOCUMENTS

D412,064 S 7/1999 Achepohl et al.
5,926,901 A 7/1999 Tseng et al.
D413,728 S 9/1999 Waguespack et al.
D415,352 S 10/1999 Beals et al.
5,964,009 A * 10/1999 Hoepfl et al. ..... 16/430
D416,685 S 11/1999 Overthun
D418,979 S 1/2000 Moskovich et al.
D419,304 S 1/2000 Moskovich et al.
D419,773 S 2/2000 Beals et al.
D420,802 S 2/2000 Cheong et al.
D420,804 S 2/2000 Juhlin et al.
D421,184 S 2/2000 Koh et al.
D421,841 S 3/2000 Achepohl et al.
6,049,936 A 4/2000 Holley
6,070,286 A * 6/2000 Cardarelli ..... 15/167.1
6,076,223 A * 6/2000 Dair et al. ..... 15/167.1
D429,566 S 8/2000 Yoshimoto et al.
D429,567 S 8/2000 Yoshimoto et al.
6,108,849 A 8/2000 Weihrauch
6,108,869 A 8/2000 Meessmann et al.
6,128,808 A * 10/2000 Jansson et al. ..... 16/431
D434,906 S 12/2000 Beals et al.
6,179,503 B1 1/2001 Taghavi-Khanghah
D439,412 S 3/2001 Volpenhein et al.
D440,767 S 4/2001 Moskovich et al.
D441,958 S 5/2001 Rueb
6,266,840 B1 * 7/2001 Munro ..... 15/167.1
D446,021 S 8/2001 Jen
D447,238 S 8/2001 Tang
D448,174 S 9/2001 Harris et al.
D448,570 S 10/2001 Harris et al.
D448,571 S 10/2001 Harris et al.
6,298,516 B1 10/2001 Beals et al.
D450,457 S 11/2001 Hohlbein
6,322,362 B1 * 11/2001 Holms ..... 433/143
6,325,626 B1 * 12/2001 Blass ..... 433/141
6,332,233 B1 12/2001 Proulx
D452,615 S 1/2002 Cheong et al.
D453,270 S 2/2002 Choong
D453,998 S 3/2002 Ping
D454,252 S 3/2002 Lee
6,353,958 B1 * 3/2002 Weihrauch ..... 15/167.1
D456,139 S 4/2002 Hohlbein
D457,323 S 5/2002 Hohlbein
D457,325 S 5/2002 Wilson et al.
D458,453 S 6/2002 Baertschi
D459,086 S 6/2002 Belton et al.
6,408,476 B1 6/2002 Cann
6,408,524 B1 * 6/2002 Lai ..... 30/324
D461,313 S 8/2002 Hohlbein
D462,178 S 9/2002 Moskovich et al.
D462,527 S 9/2002 Ping
D462,528 S 9/2002 Crossman et al.
D463,131 S 9/2002 Winter et al.
D463,132 S 9/2002 Winter et al.
D463,133 S 9/2002 Hohlbein
D463,668 S 10/2002 Yoshimoto et al.
D466,302 S 12/2002 Ping
D467,430 S 12/2002 Ping
D469,958 S 2/2003 Saindon et al.
D474,608 S 5/2003 Hohlbein
D475,531 S 6/2003 Klimeck et al.
D476,158 S 6/2003 Ling
D476,487 S 7/2003 Saindon et al.
D478,211 S 8/2003 Ping
D478,213 S 8/2003 Ping
D478,424 S 8/2003 Saindon et al.
D478,425 S 8/2003 Ping
D478,727 S 8/2003 Wong
D478,728 S 8/2003 Wong
6,601,272 B1 8/2003 Stvartak et al.
D479,047 S 9/2003 Wong
D479,914 S 9/2003 Choong
D480,213 S 10/2003 Ping
D480,214 S 10/2003 Kling et al.
D480,877 S 10/2003 Crossman et al.
D482,199 S 11/2003 De Salvo
D483,569 S 12/2003 Wong
D485,989 S 2/2004 Winkler
D486,649 S 2/2004 Sprosta et al.
6,687,940 B1 2/2004 Gross et al.
D487,195 S 3/2004 Winkler
D488,621 S 4/2004 Wong
2001/0047556 A1 12/2001 Weihrauch
2002/0100134 A1 8/2002 Dunn et al.
2002/0138931 A1 10/2002 Davies
2002/0170145 A1 11/2002 Stvartak et al.
2004/0010878 A1 1/2004 Kraemer
2004/0025272 A1 2/2004 Stvartak et al.

FOREIGN PATENT DOCUMENTS

WO WO 2003-005855 A1 1/2003

* cited by examiner

ORAL CARE IMPLEMENT

CROSS-REFERENCE TO RELATED APPLICATIONS

This application is a continuation in part of co-pending PCT Application No. PCT/US2003/029497 (designating the U.S.), filed Sep. 17, 2003, entitled "Toothbrush With Gripping Area", which claims priority of U.S. Provisional Application Ser. No. 60/412,290, filed Sep. 20, 2002. This application also is a continuation in part of co-pending U.S. patent application Ser. No. 29/189,729, filed Sep. 10, 2003. The contents of the above-noted applications are each expressly incorporated herein by reference.

FIELD OF THE INVENTION

The present invention generally pertains to an oral care implement, and in particular, to an implement with an improved handle.

BACKGROUND OF THE INVENTION

Oral care implements, especially toothbrushes, are used by many people on a daily basis. With such devices, a handle is usually provided to be grasped and manipulated by the user as needed. However, many handles are simply linear rods of relatively rigid material which are neither comfortable nor given to easy manipulation. Further, use of an oral care implement may commonly occur under wet conditions, which can cause the handle to be slippery. Accordingly, there is a need for an oral care implement that provides for improved control and greater comfort for the user.

BRIEF SUMMARY OF THE INVENTION

The invention pertains to an oral care implement with an improved handle that provides greater comfort and improved control during use.

In one aspect of the invention, the handle includes a gripping region formed by a grip member having a plurality of spaced openings that expose portions of an underlying base. In a preferred embodiment, the grip member is an elastomer and the exposed base portions are recessed in the slots. This construction provides a reliable, slip-resistant and comfortable portion to be grasped.

In one other aspect of the invention, the handle has a resilient grip body that extends through the handle to be gripped by the user's finger and thumb. In a preferred embodiment, the grip body is fit into a large opening in a base where the mass of the grip body can be shifted by pressure on either side for greater comfort and control, and to dampen the pressure applied by the brush. Moreover, the grip body also preferably includes a friction surface to resist slippage.

In one other aspect of the invention, the handle includes an inclined segment that offsets the head of the implement relative to a palm gripping region for better control and manipulation of the toothbrush or other implement. A grip body is preferably positioned along the inclined segment to further enhance the comfort and control felt by the user.

In another aspect of the invention, the handle includes a large aperture into which a resilient grip body is stably fixed. The aperture has a sidewall geometry shaped for securely engaging the resilient grip body while facilitating an easy molding process. In a preferred construction, the sidewall geometry includes at least one inclined surface which defines a narrowed portion of the aperture.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

Figure 1:
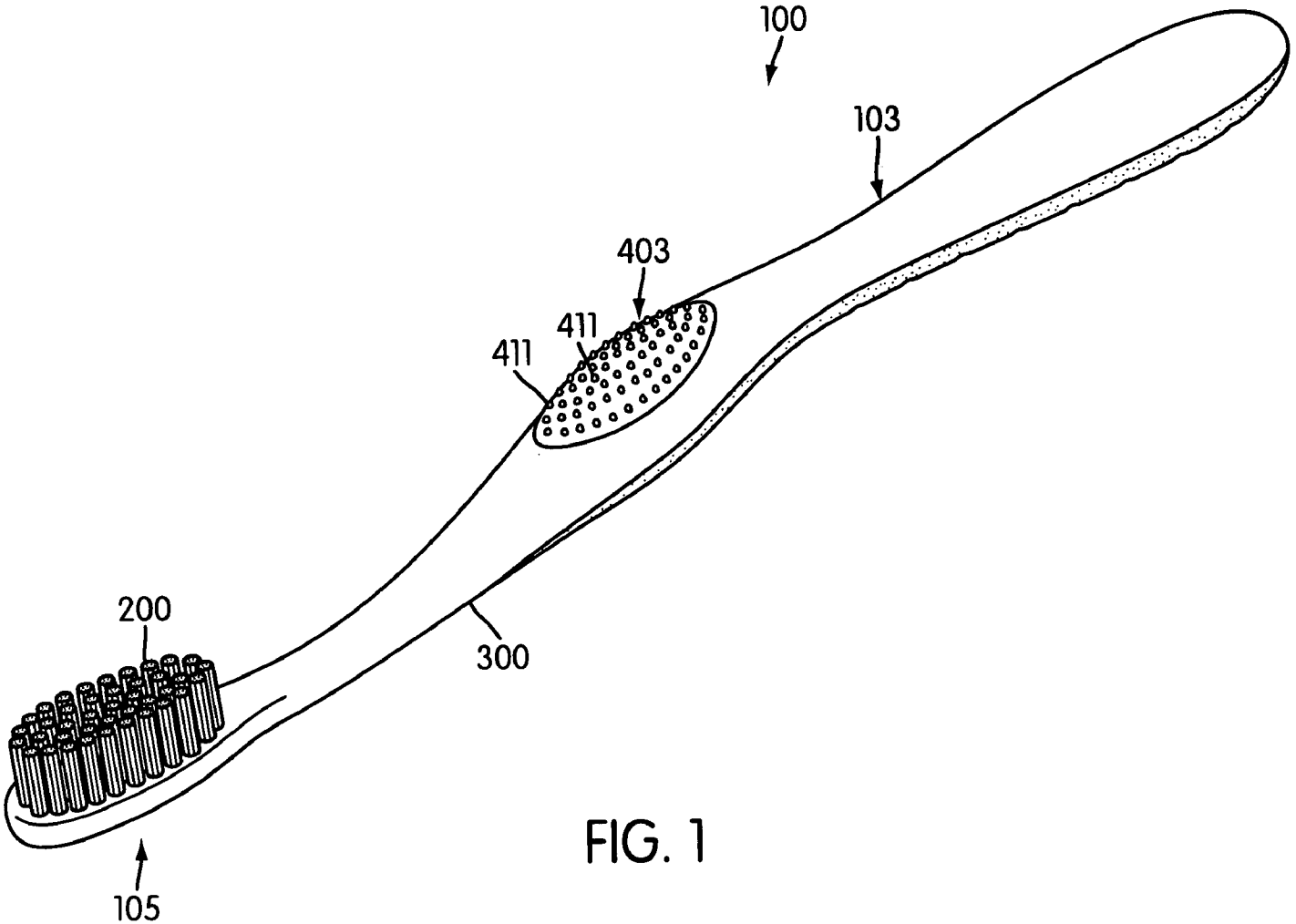
FIG. 1 is a perspective front view of an oral care implement according to one or more aspects of an illustrative embodiment.

FIGS. 1–9 illustrate an oral care implement in the form of a toothbrush 100 having an improved handle 103 and a head 105 with bristles or other tooth engaging elements. While reference is made to a toothbrush with an improved handle, other oral care implements, such as inter-proximal picks, flossing tools, plaque scrapers, tongue and soft tissue cleansers/massagers and the like, may use the same handle. It is also to be understood that other embodiments may be utilized, and that structural and functional modifications may be made without departing from the scope of the present invention.

Handle 103 is provided for the user to reliably grip and manipulate the toothbrush. Handle 103 includes ergonomic features which provide a high degree of control for the user while maintaining comfort. In a preferred construction (FIGS. 1–9), handle 103 includes a base 300, a grip body 403, and a gripping member 407. These components cooperatively form a grip portion 400 by which the user holds and manipulates the toothbrush. For optimum comfort and control, grip portion 400 includes three segments 111, 113, 115. A rear segment 115 forms a portion that generally fits comfortably within the palm of the user. A front segment 111 forms a portion that generally fits comfortably between the user's thumb and index finger. A narrow transition segment 113 connects the front and rear segments 111, 115.

In a preferred construction, front segment 111 is inclined relative to rear segment 115 to define an inclined portion positioned for comfortable gripping and to facilitate a desired offset positioning of the head relative to the palm gripping region 115. The angle θ of the incline is preferably 23 degrees, but may range approximately between 5–40 degrees. This feature allows improved control of the handle during brushing in which the head 105 can be more desirably positioned within the mouth to engage the tooth cleaning elements 200 against the teeth.

In the preferred embodiment, front and rear segments 111, 115 are widened sections that are joined by a narrowed portion 113 to form an undulating structure which is more reliably and comfortably held within the user's hand. Further, this wide construction of the palm and finger gripping regions 111, 115 requires less fine motor control by the user and is, hence, easier to hold and manipulate. In addition, front segment 111 transitions into neck 116 which, in turn, supports head 105. In a preferred embodiment, base 300 includes a gripping region 301 that corresponds to grip portion 400, the neck 116, and the head 105 to define an oral engaging region.

Under a normal use position, grip portion 400 is grasped by a user with the fingers engaging the handle 103 so that the thumb is on one side and the index finger and other fingers are positioned on the opposite side. Front segment 111 of grip portion 400 includes grip body 403 having opposing sides 405, 404 preferably for engaging the thumb and index finger of a user. Grip portion 400 further includes a rear segment 115 which enables reliable gripping of the toothbrush 100 with the third through the fifth fingers of the user's hand in a normal use position. While a normal use position is discussed, the features of the toothbrush could be employed by a user having less fingers or a user which holds the toothbrush in other ways.

Figure 4:
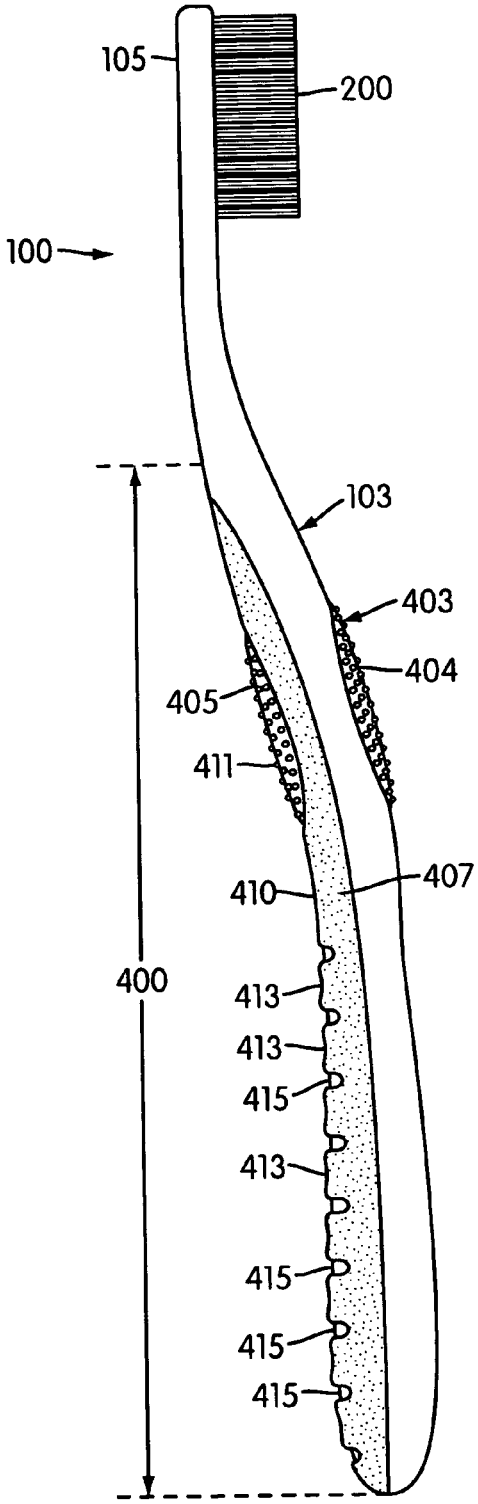
FIG. 4 is a side view of the oral care implement of FIG. 1.
Figure 8:
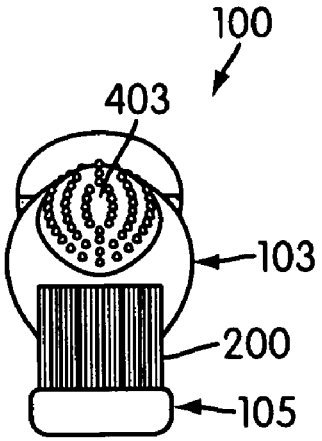
FIG. 8 is a top axial view of the oral care implement of FIG. 1.
Figure 9:
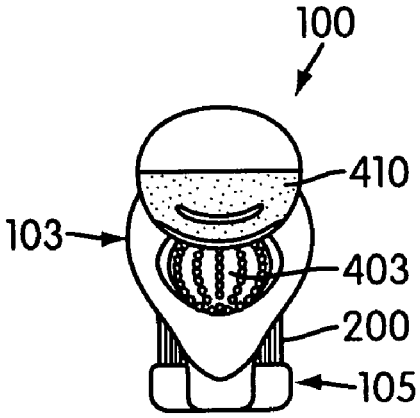
FIG. 9 is a bottom axial view of the oral care implement of FIG. 1.

In one preferred construction, front section 111 includes a soft, resilient grip body 403 fixed within aperture 303 of base 300. As shown in FIGS. 8 and 9, front section 111 has the widest transverse dimension of any other part of handle 103. As shown in FIGS. 1 and 4, aperture 303 occupies more than one-half of the transverse dimension across front section 111 of handle 103. Nevertheless, other constructions are possible. As an example only, grip body 403 may occupy a smaller portion of the transverse dimension, such as one-third of the transverse dimension of front section 111. Nevertheless, the width and length of aperture 303 may be adjusted as desired and other parts of handle 103 may be as wide as or wider than front segment 111.

Figure 5:
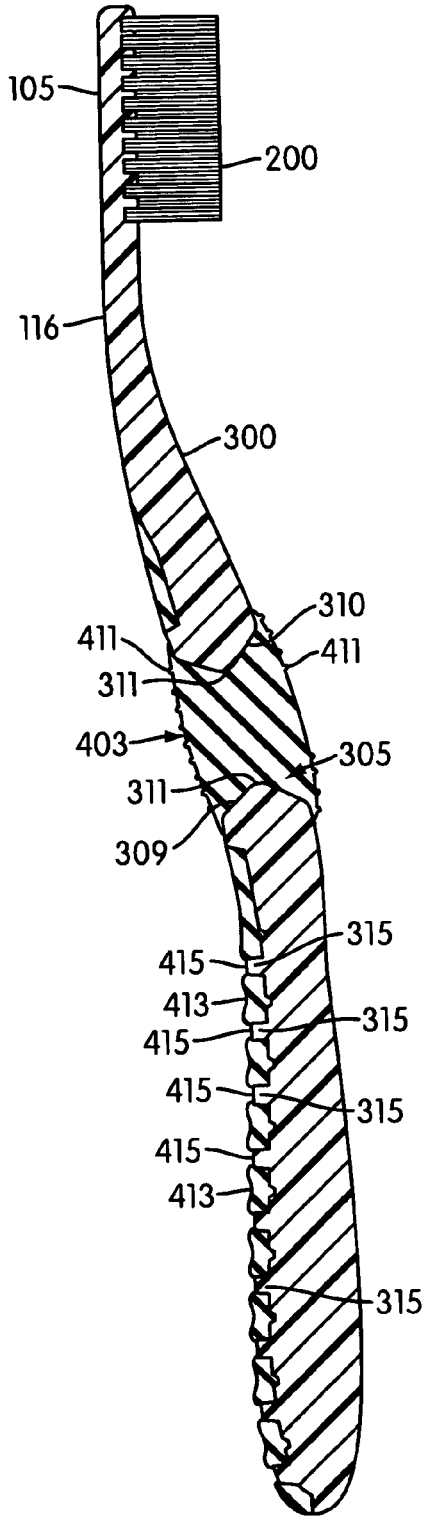
FIG. 5 is a section view of the oral care implement taken along line 5—5 in FIG. 3.
Figure 6:
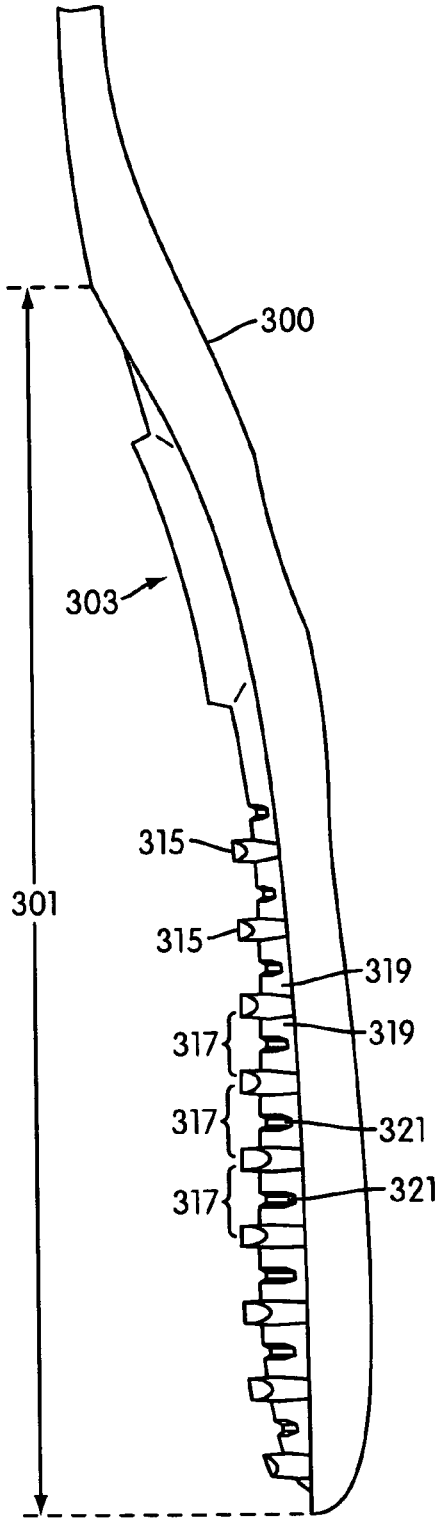
FIG. 6 is a partial side view of a base of an oral care implement of FIG. 1.
Figure 7:
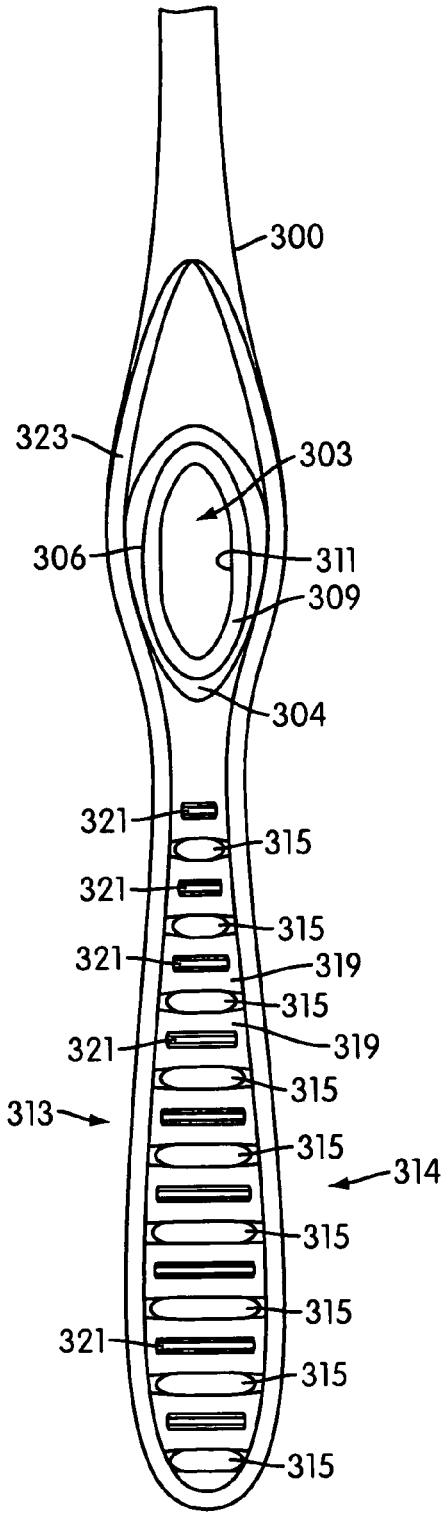
FIG. 7 is a partial front view of the base of FIG. 6.

Referring to FIGS. 5–7, in one construction, aperture 303 extends through base 300 to mount grip body 403. Aperture 303 includes a sidewall geometry 305 for the retaining and dynamic positioning of the resilient grip body 403 during use of the toothbrush. While grip body 403 is preferably molded into aperture 303, it could be premolded and mounted into aperture 303. In a preferred construction, grip member 403 is a soft, resilient element formed of a thermoplastic elastomer (TPE) which fills the aperture 303. To provide optimum comfort as well as control benefits, the elastomeric material preferably has a hardness durometer measurement ranging between A11 to A15 Shore hardness. Nevertheless, the hardness of the elastomer could also range between A8 to A24 Shore hardness. Other materials outside this hardness range could also be used. As an example, one preferred elastomeric material is styrene-ethylene/butylene-styrene (SEBS) manufactured by GLS Corporation. Nevertheless, other manufacturers can supply the SEBS material and other materials could be used.

Referring to FIGS. 1–5, resilient grip body 403 preferably has a generally bulbous shape that bulges out of aperture 303 and which resembles an oval or elliptical shape. The bulbous shape of the resilient grip body 403 enables the user to reliably roll and control the handle 103 between the thumb and index fingers during use. Grip body 403 could also be non-bulging or have any number of shapes, such as circular, a true oval shape and the like.

Referring to FIGS. 5–7, aperture 303 preferably includes a peripheral shoulder or rim 304 for supporting grip body 403. Sidewall 305 of aperture 303 extends between opposing outer surfaces of base 300 and includes inclined surfaces 309, 310 inside of the periphery of aperture 303. The inclined surfaces 309, 310 extend from the outer surfaces towards a rounded edge surface 311 which is the narrowest part of the aperture 303. This construction, in conjunction with the soft, resilient nature of grip member 403, provides a weight shifting feature which improves control of the handle 103 during use.

Resilient grip body 403 further helps attenuate the brushing force applied to the oral surfaces to prevent gum recession, loss of tooth enamel or to provide for a more comfortable brushing experience. When the toothbrush is used against the oral surfaces, such as the teeth, reaction forces are transferred to the resilient grip body 403. The elastomeric material dampens the forces against the head 105 which reduces the brush pressure applied to the teeth and soft tissue surfaces, such as the gums. In a preferred construction, elastomeric material of the resilient grip body 403 is enabled to flow and shift within aperture 303. Net pressure applied by the user's fingers is transferred to grip body 403 so that the inclined surface 309, 310 enables the elastomeric material to flow to the narrowest portion of the aperture. Hence, some of the elastomeric material squeezes past rounded edge surface 311 to the other side of the aperture while under pressure. The shifting of the material to the other side of the aperture causes a slight shift in the mass centroid of the resilient member 403 to counter balance the brushing forces. Thus, grip body 403 balances handle 103 enabling it to "float" in the hand of the user and reduce the brushing forces applied by the head 105.

In one preferred construction, grip body 403 has a multiplicity of finger grip protrusions 411 (FIGS. 1–5). Finger grip protrusions 411 provide a tactile feature to increase the friction on the user's finger surfaces and thus enhance the user's ability to grip the handle, particularly under wet conditions. Finger grip protrusions 411 are preferably provided in a desired conical or frusto-conical shape for improved grip performance. Of course, other roughened surfaces could be used.

Referring to FIGS. 6 and 7, rear segment 115 is preferably formed by base 300 and gripping member 407. In one preferred embodiment, base 300 defines a relatively rigid support structure which is at least partially overlain by an elastomeric gripping member 407. While gripping member 407 is shown as a single unitary member or layer, it could be formed by separate independent parts or sections.

Base 300 along rear segment 115 includes at least one projection, and preferably a plurality of spaced projections. While the projections could have virtually any shape, they are preferably in the form of spaced, elongate, transverse projections or ribs 315. In the preferred embodiment, ribs 315 are generally parallel with respect to each other and generally symmetrical in relation to the longitudinal axis a—a of rear segment 115. The projections 315 are preferably linear and span laterally between the longitudinal sides 313, 314 of handle 103, although they may have different transverse lengths. The transverse length of each projection 315 generally matches the width at the longitudinal location along the handle 103; although the ribs are preferably slightly short of the actual width of handle segment 115 at any one location so as to be covered on the sides by gripping member 407. Since ribs 315 span the width of segment 115, they each have varying lengths due to the variations in the width of handle segment 115. While nine projections are shown, the inventive aspects may be obtained by other numbers of projections.

In a preferred arrangement, a receiving region 317 is defined between each of the adjacent transverse projections 315. The receiving regions 317 are configured to retain and hold a layer of suitable gripping member 407, such as a thermoplastic elastomer (TPE) or other similar materials used in oral care products. In a preferable construction, receiving regions 317 have a transverse arcuate base surface 319 with a transverse groove or depression 321. The arcuate base surface 319 extends between the longitudinal sides of base 300. When a gripping member 407 is applied to the base, grooves 321 create concaved regions 413 in grip surface 410 to improve the tactile performance of the toothbrush handle (see FIG. 4). While horizontal or straight projections 315 are illustrated, the projections 315, alternatively, may be any number of shapes or orientations with respect to the longitudinal axis a—a. For example, the projections 315 may be chevron shaped, circular, oval, elliptical, rectangular, or triangular or other shapes. The orientation of the projections 315 may also be off-axis from the longitudinal axis a-a to form an asymmetrical relationship. The projections 315 may be regularly or randomly spaced on base 300 for the intended gripping performance. As shown in FIG. 7, a peripheral portion of base 300 has a peripheral groove 323 arranged to receive and hold a layer of the grip material for suitable use with the toothbrush.

Figure 2:
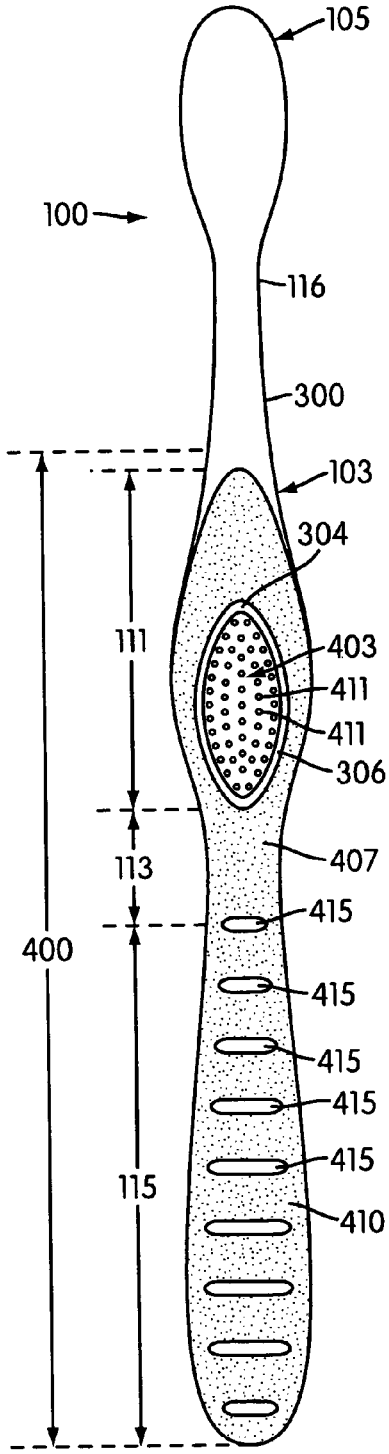
FIG. 2 is a rear view of the oral care implement of FIG. 1.
Figure 3:
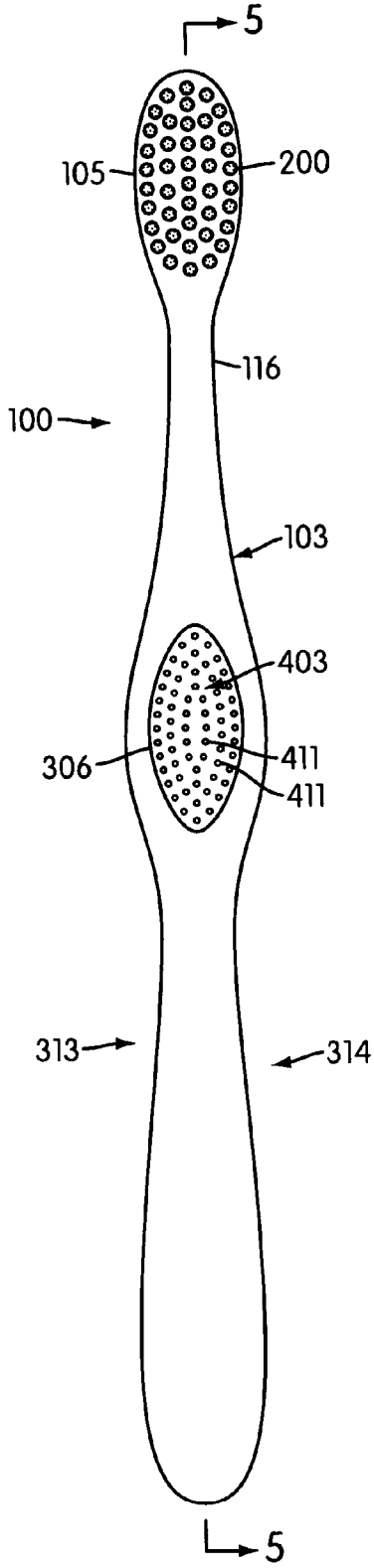
FIG. 3 is a front view of the oral care implement of FIG. 1.

Referring to FIGS. 2, 4 and 5, gripping member 407 is fixed to base 300 to provide several gripping features to improve performance. In one aspect, gripping member 407 has a grip surface 410 with at least one and preferably a plurality of spaced openings, preferably in the form of elongate transverse slots 415, which expose portions of base 300. In this way, the outline shape of slots 415 is formed by the peripheral shape of projections 315 of base 300 (FIGS. 6 and 7). To form slots 415, suitable injection molding equipment mates with the top surfaces of the projections 315 to prevent overmolding of ribs 315 and any undesired deflection of base 300 during the molding process. This enables the top surfaces of the projections 315 to be exposed after the molding process.

To provide comfort as well as control benefits, the elastomeric material of the grip surface 410 may have a hardness durometer measurement ranging between A13 to A50 Shore hardness, although materials outside this range may be used. A preferred range of the hardness durometer rating is between A25 to A40 Shore hardness. While an injection molded construction is preferred, a suitable deformable thermoplastic material, such as TPE, may be formed in a thin layer and attached to base 300 with an appropriate adhesive or by other means. Irrespective of the manufacturing process, ribs 315 are preferably recessed relative to gripping surface 410, i.e., a suitable thickness of elastomeric material is used to control the depth of the slot 415 as measured from the top of the grip surface 410 to the top of the projection (e.g., the exposed portion of base 300). In a preferred construction, the depth of the slots along axis a—a is about 0.5 mm. These transverse slots 415 prevent slippage of the handle 103 by enabling portions of the user's fingers to slightly protrude into the depth of the slot 415. Additionally, slots 415 channel water away from the fingers tips during wet operational conditions. Air is also able to enter the slots during brushing to provide some evaporative effect.

In another aspect, the grip surface 410 includes concaved regions 413 between each slot 415 to further improve the grip performance of handle 103. The concaved regions 413 are preferably created by a suitable thickness of the elastomeric material during the injection molding process filling into the transverse grooves 321 in base 300, but could be formed by other means (FIGS. 6 and 7). While base surface 319 is preferably arcuate in a transverse direction, the base surface may be horizontal or take on other shapes.

In one preferred construction, resilient grip body 403 has a different hardness as compared to the hardness of the grip surface 410. Generally, the material of grip body 403 is softer than the material forming the grip surface 410. In this manner, the handle 103 may be provided different grip features to complement the particular control need. For example, the handle 103 may have a soft forward portion with a shock absorption advantage and a slightly harder aft portion with a comfort and control advantage. The material of the resilient grip body 403 and grip surface 410 are preferably each a thermoplastic elastomer.

The inventive aspects may be practiced for a manual toothbrush or a powered toothbrush. In operation, the previously described features, individually and/or in any combination, improve the control and grip performance of oral implements. Other constructions of toothbrush are possible. For example, head 105 may be replaceable or interchangeable on handle 103. Head 105 may include various oral surface engaging elements, such as inter-proximal picks, brushes, flossing element, plaque scrapper, tongue cleansers and soft tissue massages. While the various features of the toothbrush 100 work together to achieve the advantages previously described, it is recognized that individual features and sub-combinations of these features can be used to obtain some of the aforementioned advantages without the necessity to adopt all of these features in an oral care implement.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a base with a gripping region and an oral engaging region, the base having an aperture extending therethrough;

a gripping member at least partially overlying the gripping region of the base and provided with at least one opening exposing a portion of the base; and a resilient grip body in the gripping region and extending through the aperture, the gripping member having a different durometer characteristic than the resilient grip body.

2. The oral care implement according to claim 1, in which the gripping member and the grip body comprises an elastomeric material.

3. The oral care implement according to claim 2, in which the at least one opening exposing a portion of the base is recessed to define a cavity.

4. The oral care implement according to claim 3, in which the base further includes at least one projection which has an outer surface, and the exposed portion of the base in the least one opening being the outer surface of the projection.

5. The oral care implement according to claim 2 wherein the at least one opening further comprises a plurality of the openings provided in the gripping member.

6. The oral care implement according to claim 5, in which the gripping member further includes a concaved region disposed between each pair of adjacent openings.

7. The oral care implement according to claim 6, in which the base further includes a plurality of projections and a base surface extending between the projections, wherein the base surface between each adjacent pair of said projections has a groove disposed between the projections, and wherein the groove is disposed below the concaved regions.

8. The oral care implement of claim 5, in which the openings are elongate, transverse slots.

9. The oral care implement according to claim 8, in which the slots have varying lengths along a longitudinal direction of the gripping region.

10. The oral care implement according to claim 5 wherein the resilient grip body is fixed in the aperture to define tactile finger gripping surfaces on opposite sides of the base.

11. The oral care implement according to claim 10, in which the openings in the gripping member with exposed portions of the base are recessed.

12. The oral care implement according to claim 11, in which the gripping region of the base includes a rear segment and a front segment that is inclined relative to the rear segment, the rear segment including the gripping member.

13. The oral care implement according to claim 12 wherein the aperture is formed in the front segment.

14. The oral care implement according to claim 2 wherein the grip body is surrounded by the gripping member on one side of the aperture.

15. The oral care implement according to claim 1, in which the grip body is of a softer material than said gripping member.

16. The oral care implement according to claim 15 wherein the aperture and grip body received therein has a width at its largest dimension which is more than one half of the width of the base at the same location.

17. The oral care implement according to claim 16 wherein the at least one opening further comprises a plurality of openings provided in the gripping member.

18. The oral care implement according to claim 17, in which the exposed portions of the base in the gripping member are recessed.

19. The oral care implement according to claim 1, wherein the resilient grip body is fixed in the aperture to define tactile finger gripping surfaces on opposite sides of the base.

20. The oral care implement according to claim 19 wherein the aperture and grip body received therein has a width at its largest dimension which is more than one half of the width of the base at the same location.

21. The oral care implement according to claim 1, in which the base includes first and second sections and an intermediate section that connects the first and second sections, wherein the intermediate section is narrower than the first and second sections.

22. The oral care implement according to claim 21, in which the first section is inclined relative to the second section.

23. The oral care implement according to claim 1, in which the exposed portion of the base is recessed in the gripping member to define a cavity in the opening.

24. The oral care implement according to claim 1, in which the gripping member is composed of a softer material than the base and the grip body is composed of a softer material than the gripping member.

25. The oral care implement according to claim 24, in which the at least one opening includes a plurality of openings exposing base portions that are recessed relative to the gripping member.

26. The oral care implement according to claim 1, in which the oral engaging region includes teeth cleaning elements.

27. An oral care implement comprising:

a base with a gripping region and an oral engaging region, the gripping region including a rear segment and a front segment inclined relative to the rear segment wherein the front segment is inclined relative to the rear segment at about 20–40 degrees thereby defining the inclined portion;

a resilient grip surface being disposed on the rear segment; and a grip body extending through an aperture in the base and spaced from the grip surface, the grip body forming opposite finger gripping surfaces on the inclined portion of the base.

28. The oral care implement according to claim 27, in which the grip body comprises an elastomeric material.

29. The oral care implement according to claim 27, in which the grip body is configured to counterbalance forces acting on the base.

30. The oral care implement according to claim 27, in which the grip body has a hardness of about 8–24 Shore A.

31. The oral care implement according to claim 30 wherein the resilient grip surface has a hardness of about 13–50 Shore A.

32. The oral care implement according to claim 27 wherein the grip body is spaced from the grip surface by a portion of the base.

33. The oral care implement according to claim 27 wherein the aperture and grip body received therein has a width at its largest dimension which is more than one half of the width of the base at the same location.

34. The oral care implement according to claim 27 wherein each said finger gripping surface includes a plurality of projections.

* * * * *

UNITED STATES PATENT AND TRADEMARK OFFICE
Certificate

Patent No. 7,047,591 B2 Patented: May 23, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Douglas J. Hohlbein, Pennington, NJ (US); Michael Charles Rooney, Milburn, NJ (US); Luca Casini, Milan, Italy; and Jacob Pringiers, Milan, Italy.

Signed and Sealed this First Day of August 2006.

GLADYS JP CORCORAN
*Supervisory Patent Examiner*
Art Unit 3672